United States Patent [19]

Lipscombe

[11] Patent Number: 4,606,713

[45] Date of Patent: Aug. 19, 1986

[54] ROTARY POSITIVE-DISPLACEMENT FLUID-PRESSURE MACHINES

[75] Inventor: Brian R. Lipscombe, Cheltenham, England

[73] Assignee: Dowty Hydraulic Units Limited, Cheltenham, England

[21] Appl. No.: 743,401

[22] Filed: Jun. 11, 1985

[30] Foreign Application Priority Data

Jun. 21, 1984 [GB] United Kingdom ..... 8415879

[51] Int. Cl.[4] ..... F04C 18/27

[52] U.S. Cl. ..... 418/131; 418/132; 418/206

[58] Field of Search ..... 418/131–135, 418/152, 206

[56] References Cited

U.S. PATENT DOCUMENTS

| | | | |
|---|---|---|---|
| 2,759,426 | 8/1956 | Blomgren | 418/135 |
| 2,809,592 | 10/1957 | Miller | 418/132 |
| 2,842,066 | 7/1958 | Hilton | 418/132 |
| 3,251,309 | 5/1966 | Schmiel | 418/132 |
| 3,924,029 | 12/1966 | Clark | 418/132 |

FOREIGN PATENT DOCUMENTS

| | | |
|---|---|---|
| 880816 | 10/1961 | United Kingdom . |
| 1462967 | 1/1977 | United Kingdom . |

*Primary Examiner*—Leonard E. Smith
*Assistant Examiner*—Jane E. Obee
*Attorney, Agent, or Firm*—Hayes, Davis & Soloway

[57] ABSTRACT

A rotary positive-displacement fluid-pressure machine of bi-directional type including a casing, intermeshing rotors, and a pressure-balancing arrangement, associated with the end face, remote from said rotors, of the or each end plate means of the machine. Each arrangement comprises sealing means which separate a plurality of areas on said end face, certain being subjectable to high, and others to low, fluid pressures. A further area defined by further sealing means and subjectable only to high fluid pressure is in a zone opposite, and is in positional correspondence with, that zone of the face of the end plate means engaging the rotors which is in registry with the region where the rotors mesh. The further area extends through and beyond the common plane of the rotor axes towards the low pressure side of the machine.

9 Claims, 15 Drawing Figures

ROTARY POSITIVE-DISPLACEMENT FLUID-PRESSURE MACHINES

Figure 1:
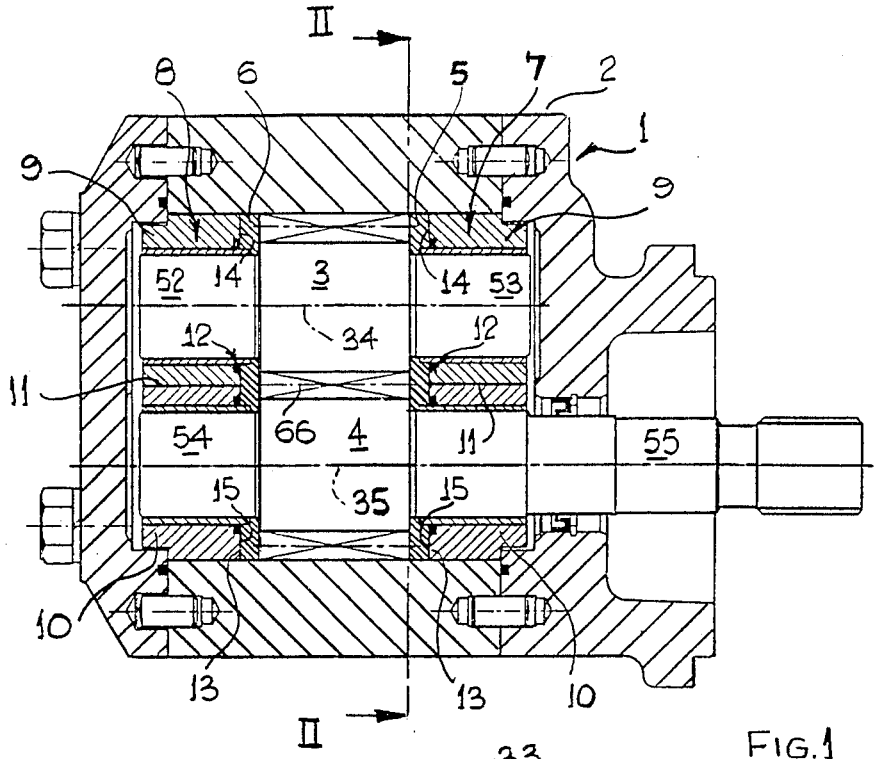

This invention relates to rotary positive-displacement fluid-pressure machines, having at least two intermeshing rotors, for example gear pumps and gear motors and more particularly to those of "bi-directional" type where operation can take place satisfactorily whatever the direction of rotation of the input shaft in the case of pumps or whatever the required direction of rotation of the output shaft in the case of motors.

Hitherto certain such fluid-pressure machines have included an arrangement whereby end plate means provided in association with the rotors of the machines are pressure-balanced. Such pressure-balancing has been intended to avoid inadvertent tilting of the end plate means and the onset of consequent premature wear of the rotors and/or end plate means otherwise experienced in machines not so provided with pressure-balancing.

In order to achieve such pressure-balancing of the end plate means, those end faces of the end plate means remote from the rotors have been so divided by sealing means as to define areas of the end faces which are subjectable to low fluid pressures and areas of the end faces which are subjectable to high fluid pressures, the relevant sizes of these areas and their disposition being so predetermined that the pressures acting thereupon in operation of the machine do so in opposition to the pressures which subsist in the working spaces of the machine and which are effective upon the end face of the or each end plate means adjacent the rotors. The pressure-balancing arrangement is intended also to urge the end plate means into adequate sealing engagement with the rotors without the generation of undue friction between the end plate means and the rotors.

It has been found in practice that the total area on those end faces of the end plate means remote from the rotors required to be subjected to high fluid-pressures is substantially greater than the total area on those end faces of said end plate means required to be subjected to low fluid-pressures. In consequence it has hitherto been desirable for those areas subjected to high pressures to extend circumferentially of the end plate means substantially beyond the plane containing the axes of the two rotors and towards the low pressure side of the machine in the direction of rotation of each rotor in the case of a motor, and in the direction opposite to the direction of each rotor in the case of a pump. From experience it has been found preferable, and in fact achieved in uni-directional machines, for the areas subjected to high pressures to also extend a predetermined amount beyond the said plane and towards the low pressure side in a zone on each said remote end face which is opposite and thus in positional correspondence with that zone of said face engaging the rotors which is in registry with the region where the teeth or lobes of the rotors are in mesh, or substantially so. However, considerable difficulty has been experienced hitherto in satisfactorily applying the latter provision to machines of bi-directional type.

The invention as claimed is intended to provide a remedy. It solves the problem of how to design a bidirectional positive-displacement fluid-pressure machine in which, for either direction of operation of the machine, the said high pressure area extends substantially beyond the plane containing the axes of the two rotors in the above-mentioned zone on the or each said end face of the end plate means remote from the rotors.

According to the invention a rotary positive-displacement fluid-pressure machine of bi-directional type includes a casing, at least two intermeshing rotors of toothed or lobed form housed for rotation in said casing, end plate means associated with said rotors, and a pressure-balancing arrangement associated with the end face, remote from said rotors, of the or each end plate means and with a face adjacent that end face, the or each said pressure-balancing arrangement comprising sealing means which separate, one from another, a plurality of areas on said end face, certain of which are subjectable to high fluid pressures and others of which are subjectable to low fluid pressures, as the case may be in dependence upon the chosen direction of rotation of said rotors, and a further area on said end face in a zone thereof which is opposite and thus in positional correspondence with that zone of the face of said end plate means engaging said rotors which is in registry with the region where the teeth or lobes of said rotors are in mesh or substantially so, said further area (a) being defined by further sealing means, (b) extending through, and substantially beyond, the plane containing the rotational axes of said rotors in the direction towards the low pressure side of said machine, and (c) being subjectable only to high fluid pressures whatever the direction of rotation of said rotors.

The said face adjacent said end face may be a face of said casing, or, may be a face of further end plate means disposed between said first end plate means and an end wall of said casing.

Fluid under pressure may gain access to said further area by way of said further sealing means which is adapted to open by deformation thereof, and/or by deformation of flexible means in engagement therewith, to permit entry of that fluid thereto.

Alternatively fluid under pressure may gain access to said further area by way of passages provided in said end plate means or said further end plate means which connect said area to whichever side of the machine is at high pressure.

The said sealing means and said further sealing means may be formed as a single element of non-extrudable material and seated in suitably shaped recesses provided in said end plate means or in said further end plate means, said element being energised so as to be urged axially into sealing engagement with the face adjacent thereto by a plurality of resilient members each of which is in contact with a portion of said single element.

Preferably said sealing element comprises two annular portions, joined at a position on their circumference by a portion of substantially square profile, and two or more radially-outwardly-directed portions extending symmetrically from each of said annular portions.

The sealing means may be of nylon or glass-filled nylon material and said resilient means may be of rubber or rubber-like material.

The advantages offered by the invention are mainly that said sealing means enables high pressure fluid directed on to the end face of the or each end plate means remote from said rotors to be so distributed thereon as to achieve, during operation of the machine, as perfect a condition of pressure-balance across the end plate means as possible.

Figure 2:
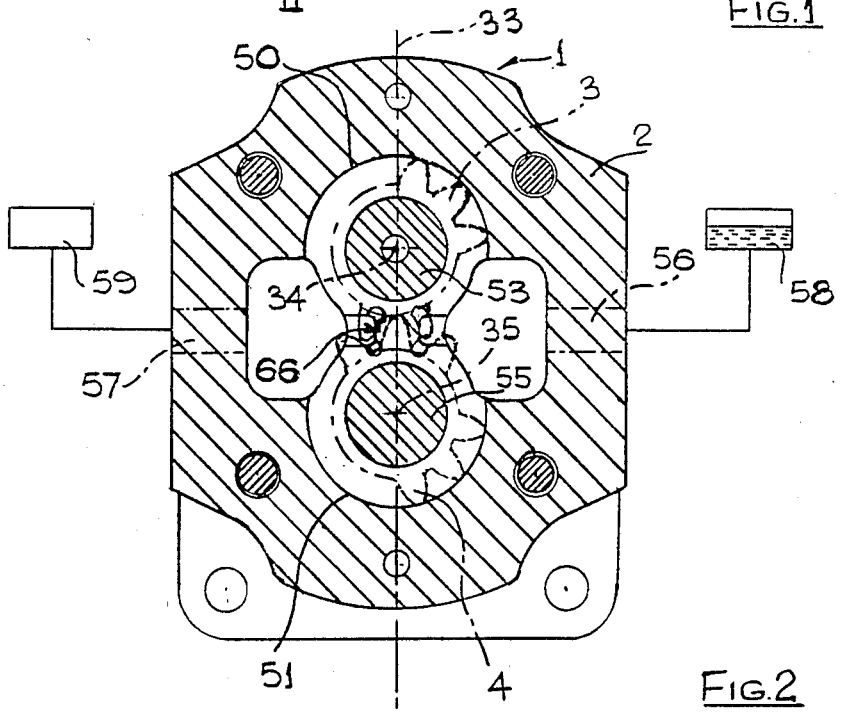
Figure 3:
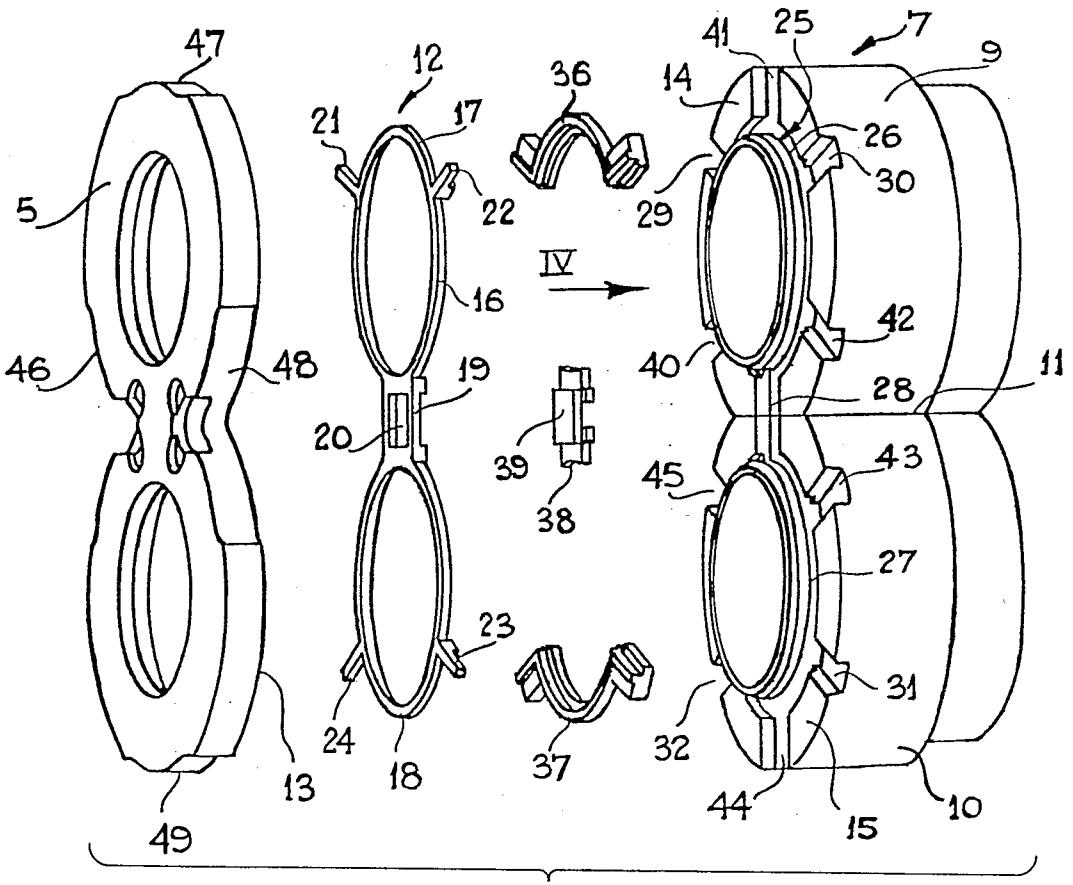
Figure 7:
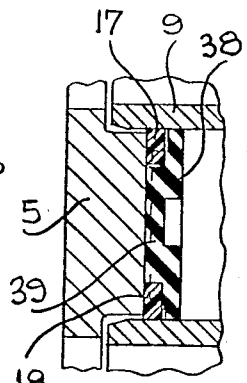
Figure 6:
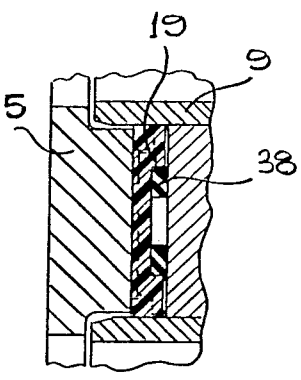
Figure 5:
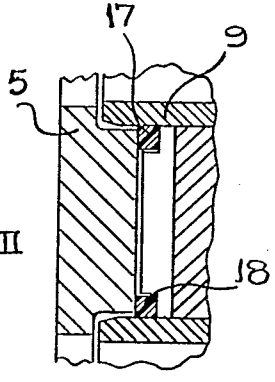
Figure 9:
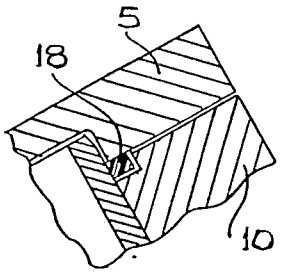
Figure 8:
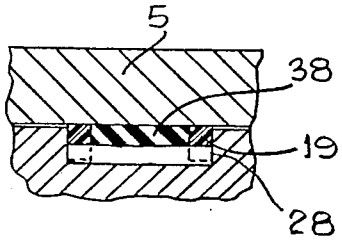
Figure 4:
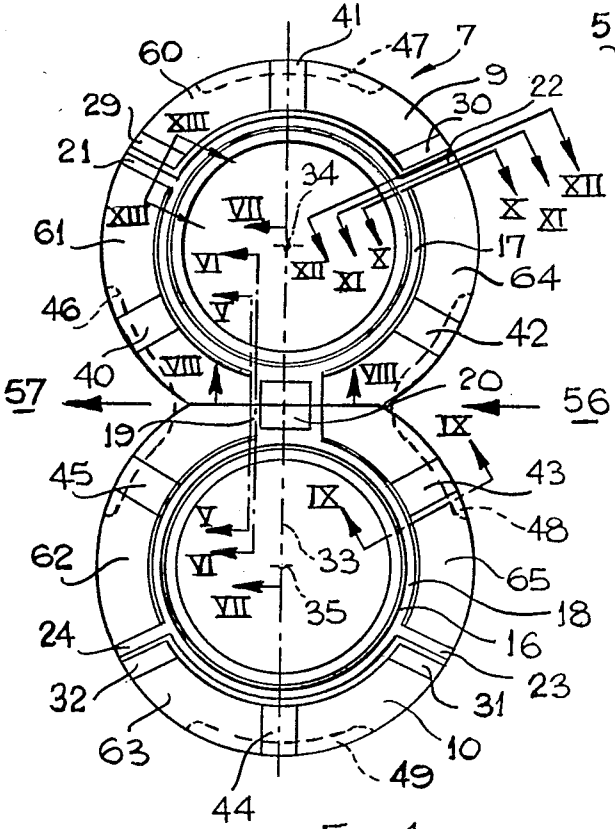
Figure 13:
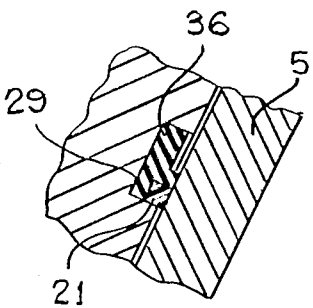
Figure 11:
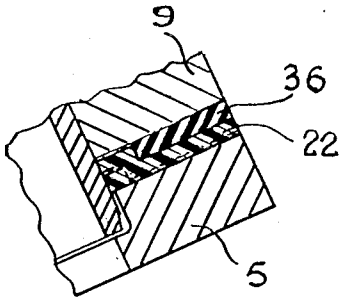
Figure 10:
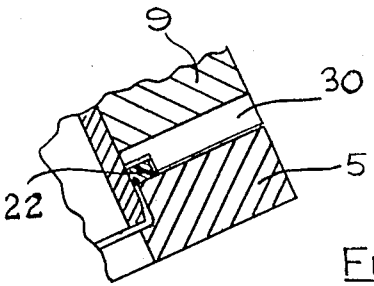
Figure 12:
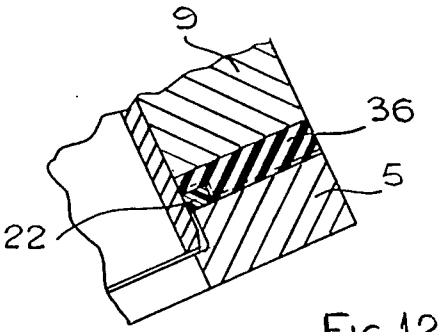
Figure 14:
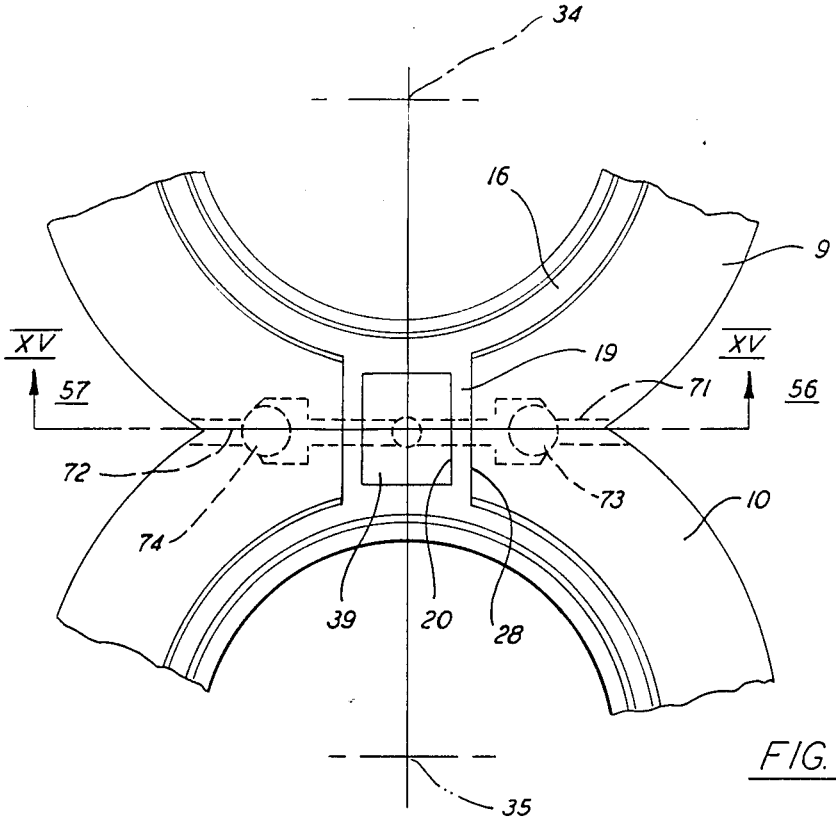
Figure 15:
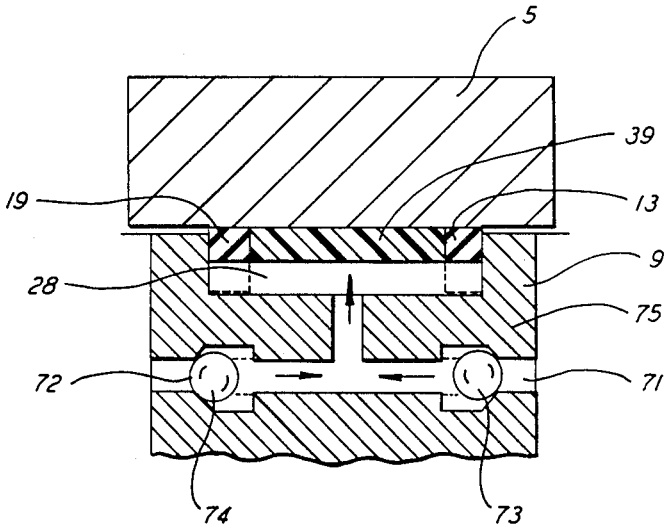

One way of carrying out the invention is described in detail below with reference to drawings which illustrate one specific embodiment, in which FIG. 1 is a cross-section of a rotary positive-displacement fluid-pressure machine in the form of a gear pump, FIG. 2 is a cross-section taken along the line II—II on FIG. 1, FIG. 3 is an enlarged and exploded view of end plate means, further end plate means and an associated pressure-balancing arrangement forming part of the construction shown in FIGS. 1 and 2, FIG. 4 is a view, taken in the direction of the arrow IV on FIG. 3, of certain of the components of FIG. 3 in their assembled condition, and, FIGS. 5 to 13 are enlarged cross-sections taken along the lines V—V to XIII—XIII, respectively, on FIG. 4, FIG. 14 is a view of an alternate arrangement of the fluid passage means;

FIG. 15 is a cross-section view take along line XV-XV of FIG. 14.

The drawings show a rotary positive-displacement fluid-pressure machine 1 in the form of a gear pump intended to draw liquid from a source and to deliver this liquid under pressure to a point of usage. The machine includes a casing 2, two intermeshing rotors 3, 4 in the form of gears housed for rotation in the casing, first end plate means 5, 6 generally of figure-of-eight profile and associated with the rotors, further end plate means 7, 8 each comprising a pair of sleeved bushes 9, 10 interengaging in plane 11, and a pressure-balancing arrangement, generally indicated at 12, associated with that end face 13 of each first end plate means 5, 6 remote from rotors 3, 4 and with the adjacent races 14, 15 of the bushes 9, 10. Each pressure-balancing arrangement 12 comprises sealing means which separate one from another a plurality of areas, individually subjectable to fluid pressures, on end faces 13 of the first end plate means 5, 6.

The sealing means comprises a single element 16 of non-extrudable nylon or glass-filled nylon material. As shown in FIGS. 3 and 4, this element comprises two annular portions 17, 18 joined together at their circumferences by a portion 19 which is of substantially square profile and which has a substantially square opening 20 therein. Four radially-outwardly-directed and symmetrically-arranged arms 21, 22, 23, 24 extend from portions 17, 18 as shown. Throughout the element 16 the cross-sectional shapes of the various portions thereof are either rectangular or square as will be seen from the cross-sectional elevations of FIGS. 5 to 13.

Element 16 is seated in suitably and correspondingly shaped recesses, generally indicated at 25, which are provided in faces 14, 15 of bushes 9, 10. As shown these recesses comprise two annuli 26, 27 which receive portions 17, 18, a substantially square well 28 which is symmetrically formed with respect to the plane 11 of abutment of bushes 9, 10, this well receiving portion 19, and four radially-disposed grooves 29, 30, 31, 32 which receive arms 21, 22, 23, 24. The well 28 is also symmetrically arranged with respect to the plane 33 containing the axes 34, 35 of rotation of the rotors 3, 4.

Each element 16 is energised so as to be urged axially into sealing engagement with face 13 of end plate means 5 or 6, as the case may be, by three members 36, 37, 38 of rubber which are seated in the recesses 25 beneath element 16. Members 36, 37 are of the shape more clearly seen in FIG. 3 and member 38 which is seated in well 28 has a substantially square portion 39 which projects into opening 20. Further recesses 40, 41, 42; 43, 44, 45, in faces 14, 15 of bushes 9, 10, provide passage means enabling high pressure liquid or low pressure liquid, as the case may be, derived from the working spaces of the pump by way of the four cut-away portions 46, 47, 48, 49 in the edge of means 5, 6, to gain access to the respective and separated areas of faces 14, 15 defined by element 16.

The rotors 3, 4 are housed in overlapping bores 50, 51 formed in casing 2, these gears having shafts 52, 53, 54, 55 extending from both sides thereof. The shaft 55, by which the pump is driven, projects to the exterior of casing 2 and all the shafts are mounted for rotation in the bushes, the first end plate means 5, 6 provided on either side of the two rotors being suitably apertured to receive the shafts.

The gear pump is operable in either direction of rotation of shaft 55 in dependence upon which of the two ports 56, 57, formed in casing 2, is connected to a source of liquid and which of them is connected to a point of usage. As shown in FIG. 2 port 56 is connected to the source, that is a reservoir 58, that port being thus the inlet or low pressure port, and the port 57 is connected to a point of usage, that is device 59 to be operated by the gear pump, that port being thus the outlet or high pressure port. Hence as viewed in FIG. 2, the rotor 4, which forms the driver gear, is rotatable in the clockwise direction, while the rotor 3, which forms the driven or idler gear, is rotatable in the anticlockwise direction. Thus when the gear pump is operated by driving shaft 55 from a suitable power source, the intermeshing rotors 3, 4 draw liquid from the reservoir into inlet port 56 and discharge this liquid under high pressure by way of outlet port 57 to device 59.

With particular reference to FIG. 4, when the pump is operating in the above direction, the areas 60, 61, 62, 63 defined by each element 16 on the end faces 14, 15 of the respective bushes 9, 10 are individually subjected to high fluid pressure derived from the high pressure side of the pump, while the areas 64, 65 also defined by each element 16 on end faces 14, 15 are individually subjected to low fluid pressure derived from the low pressure side of the pump. Further, the area of portion 19 and opening 20 form area 19/20 which is of substantially a square profile and is also subjected to high fluid pressure derived from the high pressure side of the pump, this gaining access to that area from areas 61, 62. To this end, and as viewed in FIG. 4, the left-hand vertical side part of portion 19 and/or the corresponding part of the associated rubber member 38 beneath it are subjected to deformation under the applied high pressure to permit entry of high pressure liquid to opening 20, these parts thus having a non-return inlet valving effect into well 28 so that high pressure is thereby continuously applied, through the intermediary of portions 19 and 39, over the adjacent and corresponding area of substantially square cross-section of face 13.

Hence a far larger area of the end face 13 of first end plate means 5, 6 is subjectable to high pressure than to low pressure. Since area 19/20, subjected to high pressure, extends substantially beyond the plane 33 in the direction towards the low pressure side of the pump the spread of high pressure in this zone on face 13 is as far as desirable in this embodiment in that direction.

Thus the distribution of pressure on each end face 13 of end plate means 5, 6 is such that that face is so loaded as to balance out those forces upon the end face of means 5, 6 adjacent the gears 3, 4 which arise as liquid drawn in at the port 56 is being raised in pressure by rotation of the gears and which would otherwise produce tilting of the end plate means. At the same time each end plate means is urged into adequate sealing engagement with the respective side faces of the gears without the generation of undue friction between them. By virtue of the provision of the area 19/20 subjected to high pressure more perfect pressure-balancing of the end plate means is achieved than hitherto.

If it is required to operate the pump in the reverse sense, shaft 55 is turned in the opposite direction. The port 57 then becomes the inlet port which is now suitably connected to reservoir 58 and the port 56 becomes the outlet port which is now suitably connected to device 59 to be operated by the pump. The arrangement of sealing element 16 and members 36, 37, 38 is such that high fluid pressure suitably derived from the high pressure side of the machine is now applied to areas 60, 64, 65 and 63, while areas 61, 62 are subjected to low pressure derived from the low pressure side of the pump. Also the area of the substantially square profile defined by portion 19 of element 16 is again subjected to high fluid pressure derived from the high pressure side of the pump, this gaining access to that area from areas 64, 65. To this end, and as viewed in FIG. 4, the right-hand vertical side part of portion 19 and/or the corresponding part of associated rubber member 38 are subjected to deformation to permit entry of high pressure liquid to opening 20 and thus have a non-return inlet valving effect into that area. As with the other sense of pump operation, since area 19/20, subjected to high pressure, extends substantially beyond plane 33 in the direction towards the low pressure side of the pump, the spread of high pressure in this zone on face 13 is as far as desirable in this embodiment in that direction to achieve as perfect pressure-balancing as possible.

The above significant improvement in pressure-balancing takes place because area 19/20 is in the zone opposite, and thus in positional correspondence with, that zone on the face of plate 5, 6 engaging rotors 3, 4 which is in registry with the region 66 where the teeth of the rotors are in mesh or substantially so.

During operation of the pump the area 19/20 is always subjected to high fluid pressure irrespective of the direction of rotation of the rotors.

Although in the embodiment above described with reference to the drawings the machine is operable as a pump, in alternative embodiments of the invention the machine is operable as a motor in which case either port 56, or alternatively port 57, is the high pressure, inlet port, while either the port 57, or alternatively port 56, is the low pressure, outlet port, in dependence upon the required direction of rotation of the shaft 55.

Further, although in the embodiment above described with reference to the drawings the further end plate means are, in order to support the sealing means, suitably recessed on that face thereof adjacent the first end plate means, in alternative embodiments of the invention the first end plate means are, for supporting the sealing means, so suitably recessed on that face thereof remote from the rotors. Alternatively, that face of the further end plate means remote from the first end plate means, or, that face of a wall of the machine casing adjacent said remote end face of said further end plate means is suitably recessed to support the sealing means. In yet further alternative embodiments of the invention said further end plate means are omitted so that only said first end plate means are provided and in this case the or each said sealing means is suitably supported either by the end face remote from the rotors of a said end plate means, or, alternatively, is suitably supported by that end face of a wall of the casing adjacent that remote end face.

Again, in other embodiments the sealing means may itself be supported upon a plate member or plate members disposed between either the first end plate means and the further end plate means, or, where no such further end plate means is provided, between the first end plate means and an adjacent end wall of the casing of the machine.

Although in the embodiment above described with reference to the drawings said further area is of substantially square shape, in other embodiments this area may be of other suitable shape, for example rectangular or circular.

Further, although in the embodiment above described with reference to the drawings the sealing means is formed by a single element 16, in other embodiments the sealing means may comprise two or more separate, and suitably supported, elements but nevertheless having a similar function to the single element 16.

Again, although in the embodiment above described with reference to the drawings end plate means 5, 6 and further end plate means 7, 8 are provided on each side of the rotors 3, 4, in alternative embodiments of the invention such end plate means may be provided only on one side of the rotors.

Finally, although in the embodiment above described with reference to the drawings high pressure liquid is admitted to the area 19/20 by way of the non-return inlet valving effect provided by the element 16 and associated member 38, in alternative embodiments of the invention liquid under high pressure may gain access to that well by suitable channels and/or apertures provided in said end plate means and/or said further end plate means. In FIGS. 14 and 15 the fluid passage means 71, 72 have associated non-return valves 73, 74 affording entry of high pressure fluid directly to well 28.

I claim:

1. A rotary positive-displacement fluid-pressure machine of a bi-directional type including a casing, at least two intermeshing rotors of toothed form, each having their rotational axes formed in a plane, housed for rotation in said casing, first end plate means having a face engaging said rotors and having an end face opposite to said face and thus remote from said rotors, a pressure-balancing arrangement associated with said end face and comprising sealing means which separate, one from another, a plurality of areas on said end face, some of which are subjectable to high fluid pressures and others of which are subjectable to low fluid pressures, further sealing means, a further area on said end face in a zone thereof which is opposite and thus in positional correspondence with that zone of said face engaging said rotors which is in registry with the region where the teeth of said rotors are in mesh, and fluid passage means connecting the high fluid pressure side of said machine to said further sealing means, said further area (a) being defined by the profile of said further sealing means, (b) being disposed symmetrically with respect to the plane containing the rotational axes of said rotors, (c) being disposed the same distance away from each of said rotational axes, and (d) being continuously subjected, during operation of the machine, only to high pressure, prevailing in said passage means, which is applied thereto through the intermediary of said further sealing means.

2. A machine as claimed in claim 1, wherein said sealing means are of nylon material.

3. A machine as claimed in claim 1, wherein said sealing means are of glass-filled nylon material.

4. A machine as claimed in claim 1, wherein said resilient means are of rubber or rubber-like material.

5. A machine as claimed in claim 1, wherein said high pressure, prevailing in said passage means, is applied to the underside of said further sealing means by way of a part of said further sealing means which is adapted to open by deformation of that part, thereby having a non-return valving effect towards said underside.

6. A machine as claimed in claim 1, wherein further end plate means is disposed between the first end plate means and an end wall of said casing.

7. A machine as claimed in claim 6, wherein said fluid passage means is provided in said further end plate means.

8. A machine as claimed in claim 6, wherein said sealing means and said further sealing means are formed as a single element of non-extrudable material and seated in suitably shaped recesses provided in said further end plate means, said element being energised so as to be urged axially into sealing engagement with said end face adjacent thereto by a plurality of resilient members each of which is in contact with a portion of said single element.

9. A machine as claimed in claim 8, wherein said sealing element comprises two annular portions, joined at a position on their circumference by a portion of substantially square profile which forms said further sealing means, and at least two radially-outwardly-directed portions extending symmetrically from each of said annular portions.

* * * * *